US006651473B2

(12) United States Patent
Roller

(10) Patent No.: US 6,651,473 B2
(45) Date of Patent: Nov. 25, 2003

(54) COLD-ROLLING SEAMLESS COPPER TUBING

(75) Inventor: Erling Roller, Essen (DE)

(73) Assignee: SMS Meer GmbH, Monchengladbach (DE)

( * ) Notice: Subject to any disclaimer, the term of this patent is extended or adjusted under 35 U.S.C. 154(b) by 0 days.

(21) Appl. No.: 10/077,597

(22) Filed: Feb. 15, 2002

(65) Prior Publication Data

US 2002/0116971 A1 Aug. 29, 2002

(30) Foreign Application Priority Data

Feb. 17, 2001 (DE) ..... 101 07 567

(51) Int. Cl.[7] ..... B21B 27/06

(52) U.S. Cl. ..... 72/69; 72/96; 72/201; 72/342.2

(58) Field of Search ..... 72/69–78, 96–97, 72/99, 201–342.2

(56) References Cited

U.S. PATENT DOCUMENTS 1,910,377 A * 5/1933 Becker ..... 72/69
3,967,486 A * 7/1976 Takase et al. ..... 72/69
4,154,076 A * 5/1979 Tuschy et al. ..... 72/69
4,876,870 A 10/1989 Rantanen
5,699,690 A * 12/1997 Furugen et al. ..... 72/69

FOREIGN PATENT DOCUMENTS

| | | | |
|---|---|---|---|
| DE | 1 752 996 | 7/1971 | |
| EP | 67906 | * 12/1982 | ..... 72/69 |
| JP | 3-64418 | * 3/1991 | ..... 72/69 |

* cited by examiner

*Primary Examiner*—Ed Tolan
(74) *Attorney, Agent, or Firm*—Herbert Dubno; Andrew Wilford

(57) ABSTRACT

Seamless tubing of a nonferrous material is made by continuously and concomitantly advancing a tubular workpiece of the nonferrous material along an axis through a rolling station, radially squeezing the workpiece in the station between external rolls and an internal mandrel to radially reduce a wall thickness of the workpiece and increase an axial length of the workpiece so that the workpiece is heated, and spraying a liquid coolant against the workpiece in and upstream of the station to maintain the workpiece at a temperature below a recrystallization temperature of the material.

20 Claims, 1 Drawing Sheet

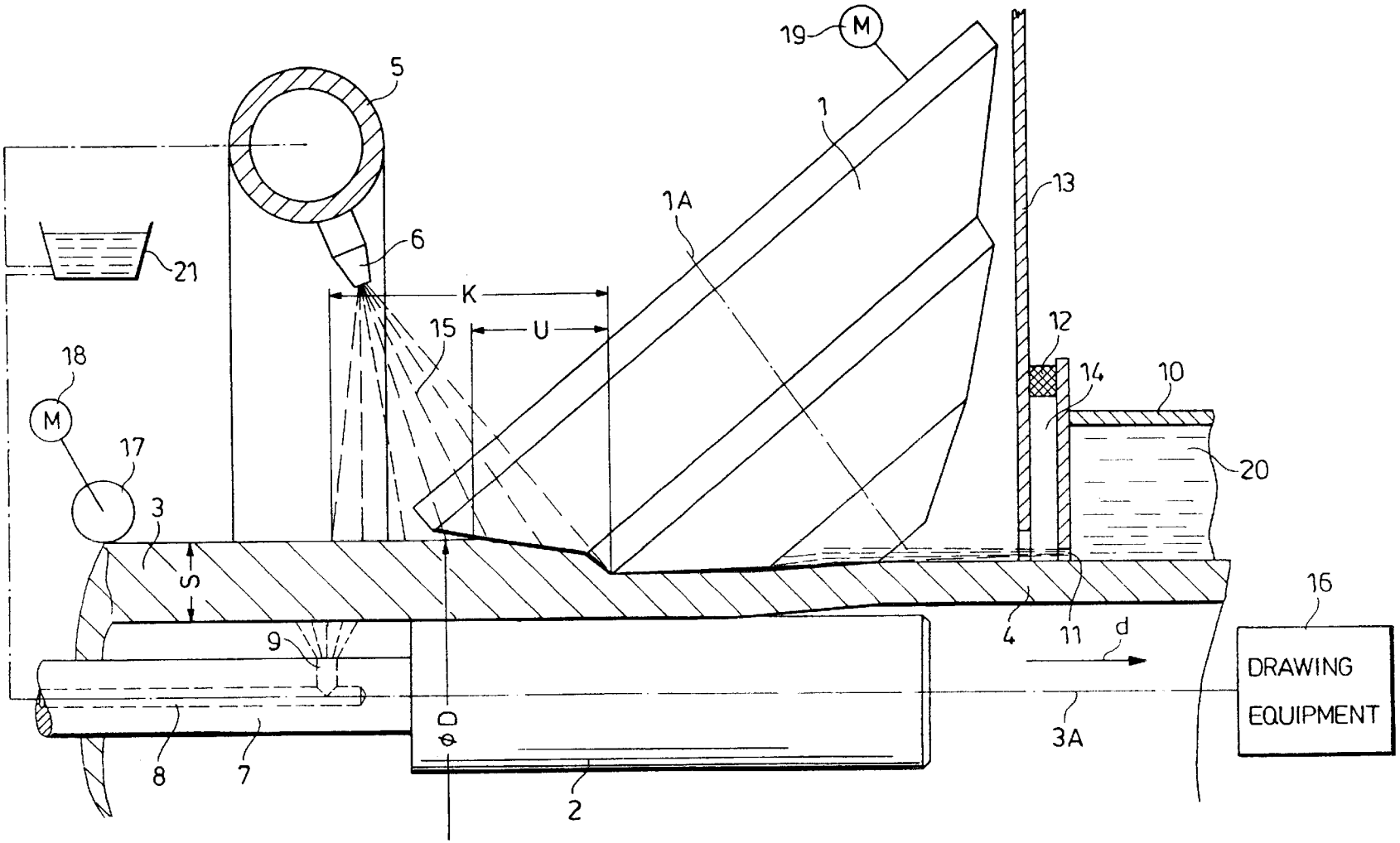
DRAWING EQUIPMENT
16
20
10
14
12
13
11
d
3A
4
1
19
M
1A
2
U
K
15
6
5
9
7
8
S
3
17
18
M
21

COLD-ROLLING SEAMLESS COPPER TUBING

FIELD OF THE INVENTION

The present invention relates to a method of making seamless nonferrous tubing. More particularly this invention concerns the production of seamless copper tubing.

BACKGROUND OF THE INVENTION

U.S. Pat. No. 4,876,870 of Rantanen describes a method of producing seamless nonferrous tubing where a tubular workpiece straight from a continuous-casting die is rolled in a planetary-roll system so that the heat created by the rolling raises the temperature of the workpiece above the recrystallization temperature. Such recrystallization forms in the workpiece a new strain-free grain structure that replaces the grain structure normally created by cold working. This system makes tubing of copper, nickel, zirconium, titanium, or alloys thereof and normally relies on a one-step thickness reduction of at least 70%. With copper a crystal size of 0.005 mm to 0.050 mm is produced when mechanical working reheats the material to between 250° C. and 750° C.

In such a process one exploits the ability to heat the material by working it so that it passes the recrystallization temperature. Thus the material goes during the cold working through two phases. First, that is on moving from near-ambient temperature as the cold-working starts, the material reaches a high temperature which rigidifies the material. With the subsequent deformation and the further temperature increase the workpiece reaches its highest temperature, normally in the neighborhood of 700° C. to 800° C. At this temperature there is a sudden recrystallization of the material, typically crated by a thickness reduction of about 70%. The resultant crystalline structure is like that produced by annealing and results in a relatively soft material, that is one with limited rigidity and resistance to deformation.

Recrystallization is often desirable since it makes subsequent working easier. For example if the tubing is to be formed with ribs, it is much easier to do this when the metal is relatively soft and deformable, as happens when internal stresses are relieved by heating above the recrystallization temperature.

In other applications the recrystallized grain structure is not wanted, for example when producing tubing for use in plumbing installations. A tubular 85/15 (i.e. 85 mm diameter and 15 mm wall thickness) SF copper workpiece is Pilger rolled out to a 58/2.4 tube and then drawn or stretched to 15/1. Pilger rolling entails the use of a reciprocal broach or mandrel inside the tubular workpiece and continuously orbiting rolls on the outside, with step-wise advance of the tube coordinated with longitudinal shifting of the broach. In some systems the work-piece can even be drawn to a 6.35/0.3 finished product. The cold Pilger-rolled tube is not heated in this process.

Copper is a workpiece which can be drawn out considerably without heating. In the above-given example to produce a 6.35/0.3 tube the overall stretching or reduction is equal to 548:1. Thus Pilger rolling is the standard system for making copper tubing. In the Pilger system the tubing is coated with a cooling emulsion so the tube leaves the rolls at a temperature less than 100° C. A disadvantage of this system is that it is impossible to feed the tubing from the planetary rolls directly to a drum-type drawing machine.

Hence the freshly rolled tubing is deposited horizontally in baskets that are carried on a conveyor system and that can raise or be raised as required to deliver the tubing at the desired level. Thus the baskets are not fixed on the conveyor but just set or hung thereon. Soft freshly rolled tubing is often damaged or marred by contact with the holding basket and other tubes when being transported to the subsequent rolling equipment. The amount of damage increases as the quantity being transported increases and is particularly high in drawing machines that must be fed a continuous supply of tubes at high speed.

Thin-walled air-conditioning/refrigeration (ACR) tubes having a wall thickness of about 0.3 mm is particularly susceptible to damage; it must be produced from a perfectly smooth workpiece. Such tubing is processed vertical in an angled planetary-roll system so that it can be fed to the slower vertical-throughput drawing machine used to make this type of tubing. The hanging bundles are normally transported by hook-type chain conveyors that are installed fixedly between the rolling and drawing installation. Thus a single-use transport system connects to a slow drawing installation. This is only true for soft tubes produced by normal angled planetary-roll systems. Were the tubes harder, it would be possible to use other transport systems that are less gentle, since the tubing would be less susceptible to damage. For instance if ACR tubing were being made from harder tubing, it could be transported from the planetary-rolling system to the drawing equipment in standard basket-type conveyors.

With Pilger rolling of cold stock the workpiece is advanced in steps. In order to produce dimensionally accurate tubing, the tubular workpiece is advanced in steps and rotated with each step through an angle of for example 57°. This advancing and rotating is effected outside the rolling system and can only be done in the brief instant when the tube is released by the Pilger rolls. The available time is very short so that the workpiece must be moved vary rapidly. Hence the mass of the workpiece is limited. In standard practice the maximum workpiece weight is therefore about 550 kg. This results in a production bottleneck, since at the Pilger-rolling equipment the workpiece must be reduced to a relatively small part and slowed down.

German patent document 1,752,996 of Dmitrijew describes a Pilger-rolling system wherein the rolls are reciprocated by a rack and thus rotated forward and backward. In this system the rolls slip on the workpiece since the drive gear radius is constant and the effective roll radius changes. The result is a poor finish on the tubing. Thin-walled tubing cannot be subjected to the longitudinal tension applied in such a system. Furthermore the discontinuous production results in considerable wear of all the machine parts, increasing down time and manufacturing costs.

In general, discontinuous production, that is movement of the workpiece in steps, creates numerous production problems, in particular when thin-walled ACR tubing is being made. The use of angled planetary rolls has the considerable advantage that it is usable in a continuous process with the workpiece never actually stopping. Thus there is no upper limit on overall workpiece size and in fact the workpiece can be rolled out as it issues from a continuous-casting die. Workpieces weighing in excess of 750 kg can easily be rolled and drawn.

Such a continuous process has, however, the considerable disadvantage that the extreme size reduction in a single stage heats the workpiece to 700° C. to 800° C., well above the recrystallization temperature. As a result the rolled workpiece is soft and weak so that it is easily damaged when subsequently handled and can only be subject to limited tension in a drawing operation.

OBJECTS OF THE INVENTION

It is therefore an object of the present invention to provide an improved system for making nonferrous tubing.

Another object is the provision of such an improved system for making nonferrous tubing which overcomes the above-given disadvantages, that is which continuously produces high-strength nonferrous tubing of relatively small wall thickness.

SUMMARY OF THE INVENTION

Seamless tubing of a nonferrous material is made by continuously and concomitantly advancing a tubular workpiece of the nonferrous material along an axis through a rolling station, radially squeezing the workpiece in the station between external rolls and an internal mandrel to radially reduce a wall thickness of the workpiece and increase an axial length of the workpiece so that the workpiece is heated, and spraying a liquid coolant against the workpiece in and upstream of the station to maintain the workpiece at a temperature below a recrystallization temperature of the material.

Thus the intermediate product produced by this system is quite hard and rigid. It is less likely to be damaged by handling, and can be subjected to considerable tension to draw it out and make its wall thickness even thinner. The production system works continuously, that is with the workpiece moving continuously at a constant speed through the rolling station so that the production speed is relatively high. The system according to the invention therefore has the advantages of the discontinuous Pilger system and those of the continuous angled planetary-roll system.

According to the invention the liquid coolant is sprayed annularly against the workpiece at a rate so as to carry off heat from the workpiece at a rate equal to more than 10,000 $W/m^2K$. The rolls engage the workpiece over an axially extending zone having a predetermined length and the liquid is sprayed against the workpiece over an axially extending zone having a length equal to at least twice the predetermined length.

Furthermore in accordance with the invention the workpiece is internally sprayed with another liquid coolant upstream of the rolls. This other liquid coolant is pure water and is sprayed at a rate such that it is fully vaporized, leaving no liquid in the workpiece.

The workpiece according to the invention is advanced at a speed of V m/sec. The rolls engage the workpiece in a zone having an axial length of U m and with a force axial lengthening the workpiece by an amount L, and the workpiece spends a time T sec passing through the zone according to the formula $T=2U/(V+V/L)+U/(V/L)$. The time T is greater than or equal to 2.5 sec.

In accordance with another feature of the invention the workpiece is contacted with a third liquid coolant downstream of the rolls to cool the workpiece to at most 100° C. This third liquid coolant contacts the workpiece immediately downstream of the rolls. The workpiece is confined according to the invention at the rolls in an atmosphere of an inert gas to prevent oxidation of the metal. The third liquid coolant contacts the work-piece where it is confined in the inert gas.

The workpiece in accordance with the invention has upstream of the rolls a ratio of diameter to wall thickness $\geqq 5:1$. The rolls axially lengthen the workpiece to an extent $\leqq 8$.

BRIEF DESCRIPTION OF THE DRAWING

The above and other objects, features, and advantages will become more readily apparent from the following description, reference being made to the accompanying drawing whose sole FIGURE is a partly diagrammatic axial section through a tubing-rolling system according to the invention.

SPECIFIC DESCRIPTION

As seen in the drawing, a tubular copper workpiece 3 centered on a horizontal axis 3A is moved in an axial direction d by a feeder here illustrated schematically as a roll 17 and motor 18. A plurality of three basically conical rolls 1A of which only one is shown press radially inward against the workpiece 3 with great force. These rolls 1 are carried in a housing 13 filled with an inert gas and are simultaneously rotated about their axes 1A and orbited about the axis 3A to deform and compress the workpiece 3 in a region U. A cylindrical broach or mandrel 2 is held stationarily inside the workpiece 3 on the axis A and extends both upstream and downstream of the deformation zone U. The rolls 7 and mandrel 2 reduce an outside diameter D of workpiece 3 and its thickness S as illustrated, turning it into a thin-walled tube 4 while at the same time lengthening it axially. Thence the tube 4 moves off to drawing equipment shown schematically at 16. This is all generally standard.

According to the invention an annular manifold ring 5 surrounds the workpiece 3 upstream of the rolls 1 and has an array of angularly equispaced and radially inwardly directed nozzles 6 of which only one is shown. The nozzles 6 form an annular spray 15 impinging on the outer surface of the workpiece 3 over a zone or region K that is axial twice as long as the zone U and whose downstream half corresponds to the zone U.

Downstream of the rolls 1 is a stationary housing 10 forming a chamber 20 that is open radially inward toward the workpiece 10 and that filled with a liquid, mainly water. The housing 10 is formed with a port 11 through which the workpiece 3 passes with play so that the liquid in the chamber 20 can flow upstream to the region of the rolls 1. A seal 12 is provided in a space 14 between the chamber 10 and the rotating wall 13 of the housing 13 holding the rolls 1 and containing the inert gas so that oxygen is not admitted to the region around the rolls 1 through the gap between the wall 13 and the workpiece 3.

The mounting rod 7 for the broach 2 is formed with a passage 8 connected to the same coolant supply 21 as the manifold ring 5. Nozzles 9 open radially outward from the rod 7 at the upstream end of the cooling zone K and emit sprays of the same coolant that serve to further cool the workpiece 3, here internally.

According to the invention the amount of liquid, here mainly water, sprayed from the nozzles 6 under relatively high pressure is sufficient to dissipate heat at rate equal to 10,000 $W/m^2K$. The sprays from the nozzle holes 9 are somewhat less powerful so that all of the liquid inside the tubular workpiece 3 is vaporized. The coolant from the housing 10 is sufficient to maintain the finished workpiece 4 at a temperature at or below 100° C. Thus the workpiece 3 does not exceed its recrystallization temperature, even though the rolling process here is continuous. The finished workpiece 4 thus is quite hard.

I claim:

1. A method of making seamless tubing of a nonferrous material, the method comprising the steps of continuously and concomitantly:

advancing a tubular workpiece of the nonferrous material along an axis through a rolling station;

radially squeezing the workpiece in the station between external rolls and an internal mandrel to radially reduce a wall thickness of the workpiece and increase an axial length of the workpiece, whereby the workpiece is heated; and spraying a liquid coolant against the workpiece in and upstream of the station at a rate so as to carry off heat from the workpiece at a rate equal to more than 10,000 W/m2K to maintain the workpiece at a temperature below a recrystallization temperature of the material.

2. The tubing-making method defined in claim 1 wherein the rolls engage the workpiece over an axially extending zone having a predetermined length and the liquid is sprayed against the workpiece over an axially extending zone having a length equal to at least twice the predetermined length.

3. The tubing-making method defined in claim 1 wherein the liquid coolant is sprayed annularly against the work-piece.

4. The tubing-making method defined in claim 3, further comprising the step of:

internally spraying the workpiece with another liquid coolant upstream of the rolls.

5. The tubing-making method defined in claim 4 wherein the other liquid coolant is pure water and is sprayed at a rate such that it is fully vaporized.

6. The tubing-making method defined in claim 1, further comprising the step of contacting the workpiece with a third liquid coolant downstream of the rolls to cool the workpiece to at most 100° C.

7. The tubing-making method defined in claim 6 wherein the third liquid coolant contacts the workpiece immediately downstream of the rolls.

8. The tubing-making method defined in claim 6, further comprising confining the workpiece at the rolls in an atmosphere of an inert gas, the third liquid coolant contacting the workpiece where it is confined in the inert gas.

9. The tubing-making method defined in claim 1 wherein the workpiece has upstream of the rolls a ratio of diameter to wall thickness ≧5:1.

10. The tubing-making method defined in claim 1 wherein the rolls axially lengthen the workpiece to an extent ≦8.

11. A method of making seamless tubing of a nonferrous material, the method comprising the steps of continuously and concomitantly:

advancing a tubular workpiece of the nonferrous material along an axis through a rolling station at a speed of V m/sec;

radially squeezing the workpiece in the station between external rollers and an internal mandrel in a zone having an axial length of U m and with a force axial lengthening the workpiece by an amount L such that the workpiece spends a time T sec passing through the zone according to the formula:

$$T=2U/(V+V/L)+U/(V/L)$$

to radially reduce a wall thickness of the workpiece and increase an axial length of the workpiece, whereby the workpiece is heated; and spraying a liquid coolant against the workpiece in and upstream of the station to maintain the workpiece at a temperature below a recrystallization temperature of the material.

12. The tubing-making method defined in claim 11 wherein T is greater than or equal to 2.5 sec.

13. The tubing-making method defined in claim 11 wherein the workpiece has upstream of the rolls a ratio of diameter to wall thickness ≧5:1.

14. The tubing-making method defined in claim 11 wherein the rolls axially lengthen the work-piece to an extent ≦8.

15. The tubing-making method defined in claim 11 further comprising the step of contacting the workpiece with a third liquid coolant downstream of the rolls to cool the workpiece to at most 100° C.

16. The tubing-making method defined in claim 15 wherein the third liquid coolant contacts the workpiece immediately downstream of the rolls.

17. The tubing-making method defined in claim 15, further comprising confining the workpiece at the rolls in an atmosphere of an inert gas, the third liquid coolant contacting the workpiece where it is confined in the inert gas.

18. The tubing-making method defined in claim 11 wherein the liquid coolant is sprayed annularly against the workpiece.

19. The tubing-making method defined in claim 18, further comprising the step of:

internally spraying the workpiece with another liquid coolant upstream of the rolls.

20. The tubing-making method defined in claim 19 wherein the other liquid coolant is pure water and is sprayed at a rate such that it is fully vaporized.

* * * * *